US005261566A

United States Patent [19]

Nakayama

[11] Patent Number: 5,261,566

[45] Date of Patent: Nov. 16, 1993

[54] SOLUTION-DROPPING NOZZLE DEVICE

[75] Inventor: Muneo Nakayama, Tokyo, Japan

[73] Assignee: Tokyo Ohka Kogyo Co., Ltd., Kanagawa, Japan

[21] Appl. No.: 946,260

[22] Filed: Sep. 16, 1992

Related U.S. Application Data

[63] Continuation of Ser. No. 353,961, May 19, 1989, abandoned, Continuation-in-part of Ser. No. 614,258, May 25, 1984, Pat. No. 4,867,345, which is a continuation-in-part of Ser. No. 347,797, Feb. 11, 1982, abandoned.

[30] Foreign Application Priority Data

Feb. 16, 1981 [JP] Japan ..... 56-21673

[51] Int. Cl.[5] ..... B05B 15/02; B65D 47/18

[52] U.S. Cl. ..... 222/108; 118/52; 118/302; 141/87; 141/90; 222/148; 222/420; 239/112

[58] Field of Search ..... 222/108, 148, 420–422; 141/85–87, 89–91; 239/106, 112, 113; 118/52, 302, 320

[56] References Cited

U.S. PATENT DOCUMENTS

| | | | |
|---|---|---|---|
| 400,358 | 3/1889 | Page | 222/108 |
| 2,874,734 | 2/1959 | Luckock et al. | 141/87 |
| 3,211,377 | 10/1965 | Brenner | 239/106 X |
| 3,601,162 | 8/1971 | Page | 141/90 |
| 3,740,041 | 6/1973 | Jones | 222/148 X |
| 3,756,458 | 9/1973 | Fill | 222/108 X |
| 3,764,041 | 10/1973 | Noll | 222/148 X |
| 3,791,342 | 2/1974 | Boyer et al. | 118/52 |
| 3,869,068 | 3/1975 | Chen | 222/148 |
| 4,350,187 | 9/1982 | Trusselle et al. | 222/148 X |
| 4,365,585 | 12/1982 | Naylor et al. | 239/112 X |
| 4,416,213 | 11/1983 | Sakiya | 118/52 |
| 4,633,804 | 1/1987 | Arii | 118/52 |
| 4,790,262 | 12/1988 | Nakayama et al. | 118/52 |
| 4,867,345 | 9/1989 | Nakayama | 222/148 X |

FOREIGN PATENT DOCUMENTS

| | | | |
|---|---|---|---|
| 0107032 | 7/1982 | Japan | 118/52 |

*Primary Examiner*—Kevin P. Shaver

*Attorney, Agent, or Firm*—Irving M. Weiner; Joseph P. Carrier; Pamela S. Burt

[57] ABSTRACT

A thin-film coating apparatus for forming a metal oxide film or diffusion source film on the surfaces of materials to be treated. The apparatus includes a solution-dropping nozzle device including an inner tube adapted to cause a solution to flow down therethrough and an outer tube enclosing the inner tube. The inner wall of the outer tube is spaced from the outer wall of the inner tube so as to define a flow path therebetween, the flow path being adapted to supply a cleaning solution to the tip portion of the inner tube. Because the tip portion of the inner tube can be cleaned efficiently, any concentration or deposition of the dropping solution is prevented from occurring at the tip portion of the inner tube.

34 Claims, 2 Drawing Sheets

PRIOR ART

SOLUTION-DROPPING NOZZLE DEVICE

This is a file wrapper continuation of application Ser. No. 353,961 filed May 19, 1989 (now abandoned), which is a continuation-in-part of application Ser. No. 614,258 filed May 25, 1984 (now U.S. Pat. No. 4,867,345), which is a continuation-in-part of application Ser. No. 347,797, filed Feb. 11, 1982 (now abandoned).

BACKGROUND OF THE INVENTION

1. Field of the Invention

The present invention relates to a thin-film coating apparatus, and more particularly, to a thin-film coating apparatus, including a solution dropping nozzle device, for forming a metal oxide film or diffusion source film on the surfaces of materials to be treated.

2. Description of Relevant Art

A variety of known types of thin-film coating apparatus are employed for forming a thin-film consisting of photoresist, metal oxide, diffusion source, and the like on the surfaces of materials to be treated. A variety of known types of nozzle devices are employed in such apparatus for the dropwise application of the coating solution onto the materials to be treated. To apply a diffusion source onto a wafer, for example, in a fabrication process of an IC, LSI or the like, as illustrated in FIG. 4 of the accompanying drawings, a wafer 51 is mounted on a spinner 50, a coating solution containing a diffusion source is applied by dropping same onto a central surface portion of the wafer 51 from a nozzle 52, and the wafer 51 is then spun at a high speed by the spinner 50 so as to provide a uniform coating of the diffusion source on the surface of the wafer 51 by virtue of the centrifugal force.

After dropping the coating solution from the nozzle 52, a small amount of the coating solution still remains at a peripheral edge portion 52*a* of the nozzle tip due to surface tension. Because the coating solution is generally prepared by dissolving a diffusion source in a solvent such as an organic solvent of relatively high volatility, in just a short time only the solvent evaporates from the coating solution remaining at the peripheral edge portion 52*a* of the nozzle tip. There thus results a gradual concentration of the coating solution and eventually the deposition of the solute, i.e., the diffusion source.

When the thus concentrated coating solution or the thus formed deposit drops onto the wafer being treated, an uneven film is applied to the wafer, thereby making the film defective. Also, when the deposited solute is directly exposed to the atmosphere, the solute is likely to chemically react thereto, thereby producing insoluble material which necessarily disturbs the treatment. This is highly disadvantageous in consideration of the quality of the finished product.

The aforesaid disadvantage is also encountered when forming a metal oxide film on the wafer, because in this case the coating solution is also generally prepared by dissolving an agent for forming a metal oxide, such as tetraalkoxysilane, in an organic solvent of relatively high volatility. However, the aforesaid disadvantage is rarely encountered when forming a photoresist film on the wafer, because in this case the solvent for preparing the coating solution is of relatively low volatility.

Specifically, the kinds of solvents for preparing the coating solutions including the photoresist, diffusion source and agent for forming metal oxide are as follows, wherein the evaporation rate per a unit time of each solvent is indicated by means of proportion assuming the proportion of evaporation rate of n-butyl acetate (normal butyl acetate=$C_4H_9OCOCH_3$) as 100, and noting that each solvent has been employed in practice by virtue of its reaction and coating characteristics:

TABLE I

| Solute | Solvent | Proportion of Evaporation Rate of the Solvent |
|---|---|---|
| Diffusion source, or agent for forming a metal oxide | methyl alcohol | 460 |
| | ethyl alcohol | 190 |
| | n-propyl alcohol | 110 |
| | iso-propyl alcohol | 170 |
| | sec-butyl alcohol | 120 |
| | ethyl acetate | 590 |
| | n-propyl acetate | 230 |
| | iso-propyl acetate | 159 |
| | n-butyl acetate | 100 |
| | iso-butyl acetate | 140 |
| | sec-butyl acetate | 200 |
| | ethylene glycol mono-ethyl ether | 20 |
| | ethylene glycol mono-butyl ether | 10 |
| Photoresist | ethylene glycol mono-ethyl ether acetate | 25 |
| | ethylene glycol mono-butyl ether acetate | 3 |

NOTE:
The percentage evaporated (at atmospheric pressure) of n-butyl acetate is 100% in 7.9 hours.

In order to avoid the aforesaid disadvantage, the dropping of a concentrated coating solution or deposit has been prevented conventionally by wiping the nozzle tip portion with sponge, cloth, filter paper or the like, which may optionally be impregnated with a solvent. However, such a conventional method necessarily relies upon troublesome manual operations, and thus involves problems from the standpoint of mass productivity. In addition, it is rather difficult to conduct such wiping-off operation where the spacing between the nozzle and the spinner is not sufficient, thereby possibly leading to an accidental dropping of a foreign material onto the surface of the wafer. Furthermore, such a conventional method does not permit the carrying out of the coating step and its preceding and subsequent steps as a series of continuous operations, thereby impeding the full automation of a fabrication process.

The present invention effectively overcomes the foregoing problems and disadvantages attendant the conventional techniques.

SUMMARY OF THE INVENTION

The present invention provides a thin-film coating apparatus comprising a solution dropping nozzle device for applying in a dropwise manner a thin-film forming coating solution onto a material to be treated, the thin-film comprising a metal oxide film or a diffusion source film. A spinner is provided for rotating the material, and a casing is provided for enclosing the material. The solution dropping nozzle device comprises an inner tube adapted to cause the coating solution to flow down therethrough in a dropwise manner, the inner tube having a diameter of approximately 1.5 mm; an outer tube enclosing the inner tube and having a diameter of approximately 3 mm; and the inner wall of the outer tube being spaced from the outer wall of the inner tube so as to define a flow path therebetween. The flow path is adapted to supply a cleaning solution to a tip portion of the inner tube, and the nozzle device is supported by means of a supporting member provided at a circumferential portion of the outer tube.

The present invention also provides a solution-dropping nozzle device comprising an inner tube adapted to cause a solution to flow down therethrough, an outer tube enclosing the inner tube, the inner wall of the outer tube being spaced from the outer wall of the inner tube so as to define a flow path therebetween, the flow path being adapted to supply a cleaning solution to a tip portion of the inner tube, and the inner tube and the outer tube being joined together by means of a spiral support member.

An object of the present invention is to provide a solution-dropping nozzle device which is free from the concentration of a dropping solution at the nozzle tip portion or the deposition of a solute in the dropping solution at the nozzle tip portion.

The above and further objects, details and features of the present invention will become apparent from the following detailed description of certain preferred embodiments of the invention, taken in conjunction with the accompanying drawings.

DETAILED DESCRIPTION OF PREFERRED EMBODIMENTS

Figure 1:
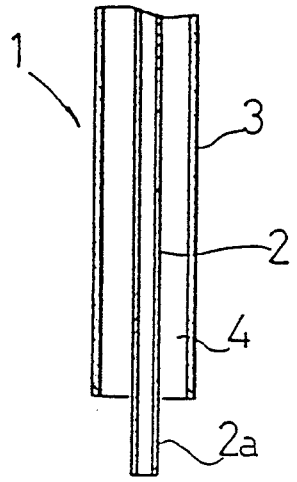
FIG. 1 is a fragmentary vertical cross-sectional view of a solution-dropping nozzle device of a thin-film coating apparatus according to a first embodiment of the present invention.
Figure 3:
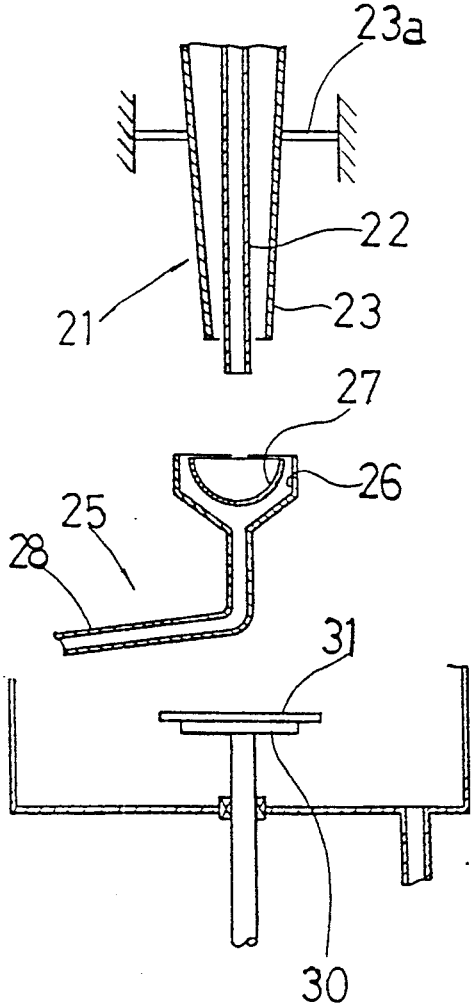
FIG. 3 is a schematic illustration of the solution-dropping nozzle device according to a second embodiment of the present invention, also applied to a thin-film coating apparatus.

With reference to FIG. 1, the solution-dropping nozzle device of a thin-film coating apparatus in accordance with a first embodiment of the present invention includes a nozzle 1 adapted to dropwise apply a thin-film forming coating solution onto a wafer 31 mounted on a spinner 30 (FIG. 3). The spinner 30 is partially enclosed in a casing 32 which captures material spun off the wafer 31. As shown, the casing 32 is open at its upper end and has a discharge tube extending downwardly from its bottom wall. Relatedly, the nozzle device 1 is substantially exposed to an atmosphere in which the thin-film coating apparatus is disposed, or in other words the atmosphere surrounding the tip of the nozzle device 1 is not specially controlled during a coating process.

The thin-film formed by the coating solution may comprise a metal oxide film or a diffusion source film, the solution being prepared with a solvent of relatively high volatility. In contrast, as noted hereinabove, when a coating solution is prepared for forming a photoresist film on the wafer, the solvent for preparing the coating solution is of relatively low volatility.

The nozzle 1 is formed of an inner tube 2 through which the diffusion source-containing coating solution flows downwardly and an outer tube 3 disposed coaxially relative to the inner tube 2 so as to enclose the outer wall of the inner tube 2. Between the outer wall of the inner tube 2 and the inner wall of the outer tube 3 there is formed a hollow flow path 4 through which an organic solvent flows down and is supplied. As discussed further hereinbelow, the distance between the inner and outer tubes will preferably be set at approximately 0.4 mm. A tip portion 2*a* of the inner tube 2 protrudes slightly downwardly from the tip portion of the outer tube 3.

A solvent is supplied to a peripheral edge portion at the tip portion 2*a* of the inner tube 2 from the solvent flow path 4 formed between the outer wall of the inner tube 2 and the inner wall of the outer tube 3, thereby dissolving and washing away any concentrated solution or deposit remaining at the peripheral edge portion of tip portion 2*a* and thus cleaning the peripheral edge portion.

Figure 2:
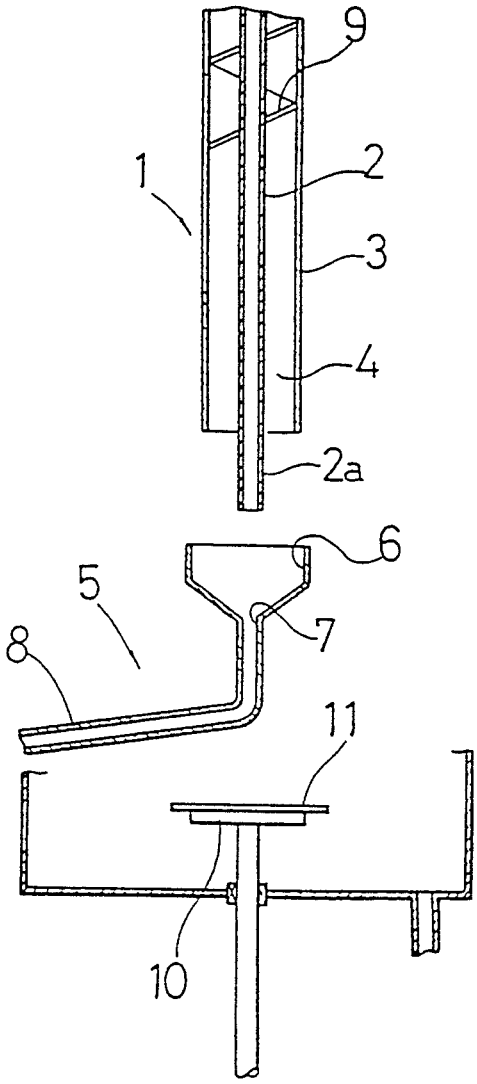
FIG. 2 is a schematic illustration of the solution-dropping nozzle device of FIG. 1 applied to a thin-film coating apparatus.

Washing of the peripheral edge portion of tip portion 2*a* is carried out by using a discharge device 5 as shown in FIG. 2 because it is undesirable to drop a solvent cleaning solution directly onto the spinner or the like when cleaning the peripheral edge portion of tip portion 2*a*.

The discharge device 5 comprises funnel-like receiver 6 having a diameter substantially larger than that of the outer tube 3 of the nozzle device and a discharge pipe 8 communicating with an opening 7 formed through the bottom of the receiver 6. The discharge device 5 is arranged so as to be located substantially immediately below the nozzle device 1 during each cleaning operation, but is displaced to a location alongside the nozzle device 1 while the coating solution is being dropped. In FIG. 2, reference numerals 10 and 11 designate respectively a spinner of a typical rotary thin-film coating apparatus and a material placed on the spinner for treatment, such as a semiconductor wafer or the like.

As shown in FIG. 2, a spiral member 9 supports the inner tube 2 and outer tube 3 with a predetermined spacing therebetween. Due to the provision of the spiral member 9, the solvent is caused to flow down through the outer tube 3 while rotating in the tube 3 and is thus capable of evenly washing the peripheral edge portion of the tip portion 2*a* of the inner tube 2.

FIG. 3 shows a second embodiment of the present invention. A supporting member 23*a* is provided at a circumferential portion of an outer tube 23, to thereby fixedly support a nozzle device 21. A catching bowl 27 is also provided in a receiver 26 of a discharge device 25 to tentatively catch a cleaning solvent until the bowl 27 is filled with the cleaning solvent, and to then allow the cleaning solvent to overflow. The thus overflown solvent is then discharged through a discharge pipe 28.

The present invention will hereinafter be described further with reference to the following experiments.

EXPERIMENT 1

A thin-film coating apparatus was constructed as shown in FIG. 2 using a nozzle of a double wall structure comprising an inner tube having a diameter of 1.5 mm and an outer tube having a diameter of 3 mm, the tip portion of the inner tube protruding by 5 mm from the tip portion of the outer tube.

The inner tube of the above nozzle was then supplied with a coating solution in the form of "OCD" (trade name for a silica-film coating solution of a concentration of 5.9% in terms of $SiO_2$, product of Tokyo Ohka Kogyo Co., Ltd.), while ethyl alcohol was fed to the outer tube of the nozzle. From the inner tube, 1 ml of "OCD" was applied dropwise onto a wafer. Thereafter, a receiver of a discharge device was placed below the nozzle and 3 ml of ethyl alcohol was permitted to flow out from the outer tube to wash the tip portion of the nozzle.

As a result, even after the lapse of a 30 minute period from the time of cleaning, no deposition of solid substances and no concentration of the dropping solution was observed at the tip portion of the nozzle. The above dropping and cleaning operations were repeated many times, with the same superior cleaning result being obtained each time.

EXPERIMENT 2

A thin-film coating apparatus was constructed as shown in FIG. 2 using a nozzle of a double wall structure comprising an inner tube having a diameter of 1.5 mm and an outer tube having a diameter of 3 mm, the tip portion of the inner tube protruding by 2 mm from the tip portion of the outer tube.

The inner tube of the above nozzle was then supplied with a coating solution in the form of "OCD", while ethyl alcohol was fed to the outer tube of the nozzle. From the inner tube, 1 ml of "OCD" was applied dropwise onto a wafer. Thereafter, a receiver of a discharge device was placed below the nozzle and 3 ml of ethyl alcohol was permitted to flow out from the outer tube to wash the tip portion of the nozzle.

As a result, again even after the lapse of a 30 minute period from the time of cleaning, no deposition of solid substances and no concentration of the dropping solution was observed at the tip portion of the nozzle. The above dropping and cleaning operations were repeated many times, with the same superior cleaning result being obtained each time.

According to the present invention it is possible to set the protruding distance of the tip portion of the inner tube 2 from the tip portion of the outer tube 3 in a range of 2–6 mm, and preferably in a range of 2–3 mm.

EXPERIMENT 3

Figure 4:
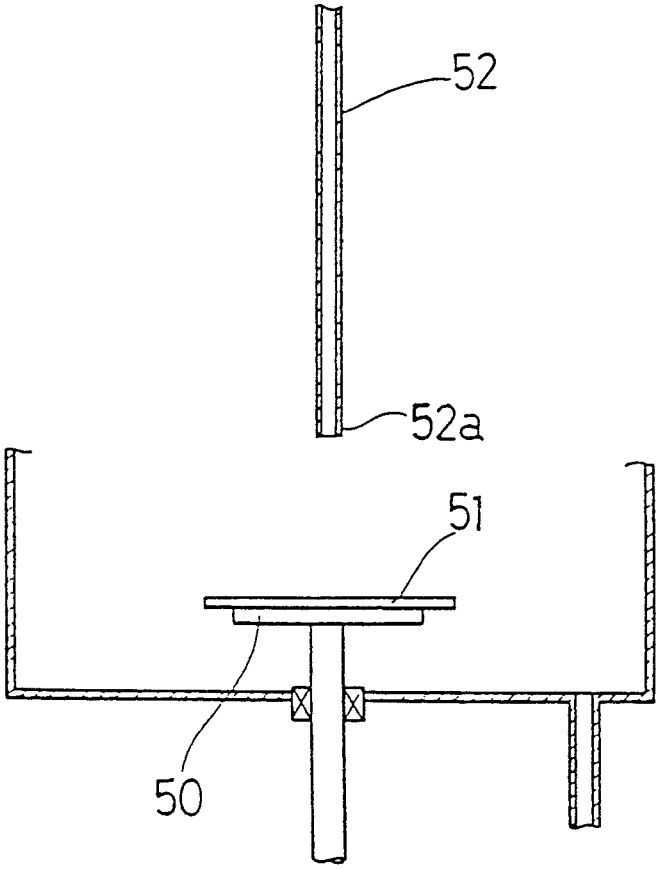
FIG. 4 schematically illustrates a conventional solution-dropping nozzle device applied to a typical thin-film coating apparatus.

In order to compare the results of Experiments 1 and 2 with those obtained from the use of a conventional nozzle, the same coating solution as employed in Experiment 1 was dropped using the conventional nozzle shown in FIG. 4 (diameter of 1.5 mm).

As a result, the deposition of a white solid substance was observed at the tip portion of the nozzle within a very short time, i.e., within two minutes or so after the dropwise application of the coating solution.

It is also possible to set the dimensions of the inner tube 2 and outer tube 3, as follows, by way of examples:

TABLE II

| | inner tube 2 | | outer tube 3 |
|---|---|---|---|
| | inner diameter | outer diameter | inner diameter |
| 1. | 0.8 mm | 1.58 mm | 2.0 mm |
| 2. | 1.11 mm | 1.61 mm | 2.0 mm |
| 3. | 2.0 mm | 3.0 mm | 3.4 mm |
| 4. | 1.6 mm | 3.17 mm | 3.57 mm |

In this respect, it is practically preferable to set the difference between the outer diameter of inner tube 2 and the inner diameter of outer tube 3 at approximately 0.4 mm.

The above noted coating solution may have viscosity in the range of 1.0 to 3.1 cP, and be flowed down through the inner tube 2 in a dropwise manner at a rate of 0.3 to 1.5 $cm^3$/second.

Further, each of the following solvents can be used as the cleaning solution, by itself or in combination with some of the others, and be flowed down through the hollow flow path 4 at a rate of 0.3 to 1.5 $cm^3$/second:

wherein: the reference characters represent physical characteristics of the solvents such that:

b.p.: boiling point (° C.);

$\mu$: viscosity (cP);

d: specific gravity; and $\gamma$: surface tension (dyn/cm).

TABLE III

| | b.p. | $\mu$ | d | $\gamma$ |
|---|---|---|---|---|
| methyl alcohol | 64.5 | 0.59 | 0.79 | 22.5511 |
| ethyl alcohol | 78.3 | 1.22 | 0.79 | 22.1 |
| iso-propyl alcohol | 82.3 | 2.41 | 0.78 | 20.8 |
| n-butyl alcohol | 117.7 | 2.95 | 0.81 | 23.8 |
| ethylene glycol mono-methyl ether | 124.4 | 1.72 | 0.97 | 35.0 |
| ethylene glycol mono-butyl ether | 171.2 | 6.42 | 0.90 | 31.5 |
| propylene glycol mono-methyl ether | 120.0 | 1.75 | 0.92 | 27.1 |
| propylene glycol mono-propyl ether | 149.8 | 2.8 | 0.89 | — |
| methyl acetate | 57.8 | 0.36 | 0.93 | 24.8 |
| ethyl acetate | 77.1 | 0.45 | 0.90 | 23.9 |
| n-butyl acetate | 126.5 | 0.69 | 0.88 | 25.2 |
| acetone | 56.2 | 0.34 | 0.79 | 26.2 |
| ethyl methyl ketone | 79.6 | 0.42 | 0.81 | 24.6 |
| ethylene glycol mono-ethyl ether acetate | 156.4 | 1.32 | 0.97 | 31.8 |
| ethylene glycol mono-ethyl ether | 134.8 | 2.05 | 0.93 | 32.0 |

It should be noted that the above description and experiments are illustrative of only certain embodiments of the present invention.

Further, it should be noted that it is entirely at the discretion of the particular user as to whether the nozzle device according to the present invention is employed in combination with the discharge device. For example, where no discharge device is employed, it may be possible to provide a rotator equipped with a spinner or nozzle which is displaceable to a side location, thereby preventing the cleaning solution from dropping onto the surface of the spinner upon cleaning the nozzle.

In the illustrated embodiments, description has been made with reference to examples of dropwise application of a coating solution containing a diffusion source for semiconductors. It will of course be understood, however, that the present invention is in no manner limited to such specific examples.

In this respect, it is to be noted that the solution-dropping nozzle device in accordance with the present invention is especially suitable for use as a dropping nozzle for a solution containing a relatively volatile solvent, which is subject to rapid evaporation of only the solvent from the coating solution remaining at the peripheral edge portion of the nozzle tip.

As apparent from the foregoing description, a nozzle in a thin-film coating apparatus for dropping a solution such as a coating solution is constructed in accordance with the present invention by an inner tube which causes the solution to flow down therethrough and an outer tube enclosing the outer wall of the inner tube with a spacing therebetween so as to define a flow path, the flow path being adapted to supply a cleaning solution to the tip portion of the inner tube and the nozzle device being supported by a supporting member provided at a circumferential portion of the outer tube. Due to such structure, the solution is prevented from being concentrated or having its solute deposited at the tip portion of the nozzle, thereby completely avoiding any disadvantageous uneven coating and thus successfully improving the product yield.

Because the solution-dropping nozzle device in accordance with the present invention does not require any manual wiping operation or the like, it is possible to carry out the coating step and its preceding and subsequent steps as a series of continuous operations. Consequently, materials can be treated and/or processed through a fully automatic continuous operation. Moreover, the solution-dropping nozzle device of the present invention can be formed of a double-walled tube which in turn comprises an inner and outer tube. Thus, the structure is simplified and is easy and inexpensive to fabricate. Accordingly, the solution-dropping nozzle device in accordance with the present invention provides a number of important advantages.

Although there have been described what are at present considered to be the preferred embodiments of the invention, it will be understood that the invention may be embodied in other specific forms without departing from the spirit or essential characteristics thereof. The present embodiments are therefore to be considered in all respects as illustrative, and not restrictive. The scope of the invention is indicated by the appended claims rather than by the foregoing description.

I claim:

1. A thin-film coating apparatus, comprising:

a solution dropping nozzle device for applying in a dropwise manner a thin-film coating solution onto a material to be treated;

said thin-film forming coating solution comprising (i) a diffusion source, as a solute, and (ii) an organic solvent of relatively high volatility, as a solvent;

a spinner adapted to rotate said material;

a casing for enclosing said material, said casing being open upwardly; and wherein said solution dropping nozzle device comprises:

an inner tube adapted to cause said coating solution to flow down therethrough in a dropwise manner, said inner tube having a diameter of approximately 1.5 mm;

an outer tube enclosing said inner tube, said outer tube having a diameter of approximately 3 mm;

the inner wall of said outer tube being spaced from the outer wall of said inner tube so as to define a flow path therebetween;

said flow path being adapted to supply a cleaning solution to a tip portion of said inner tube to thereby wash away any concentrated solution or deposit remaining at a peripheral edge portion of said inner tube; and said nozzle device being supported by means of a supporting member provided at a circumferential portion of said outer tube.

2. A thin-film apparatus according to claim 1, wherein:

said tip portion of said inner tube protrudes substantially outwardly from a tip portion of said outer tube by approximately 2–6 mm.

3. A thin-film apparatus according to claim 1, wherein:

said nozzle device is substantially exposed to an atmosphere in which said thin-film apparatus is disposed.

4. A thin-film apparatus according to claim 1, wherein:

said flow path is adapted to flow said cleaning solution downwardly around said tip portion of said inner tube at a rate of 0.3–1.5 $cm^3$/sec.

5. A thin-film apparatus according to claim 1, further comprising:

a discharge device disposed substantially proximal to said tubes for receiving said cleaning solution.

6. A thin-film coating apparatus according to claim 5, wherein:

a receiver of said discharge device is disposed substantially proximal to said tubes and includes a catching bowl, and is adapted to tentatively receive said cleaning solution and then allow said cleaning solution to overflow.

7. A thin-film coating apparatus, comprising:

a solution dropping nozzle device for applying in a dropwise manner a thin-film coating solution onto a material to be treated;

said thin-film forming coating solution comprising (i) an agent for forming metal oxide, as a solute, and (ii) an organic solvent of relatively high volatility, as a solvent;

a spinner adapted to rotate said material;

a casing for enclosing said material, said casing being open upwardly; and wherein said solution dropping nozzle device comprises:

an inner tube adapted to cause said coating solution to flow down therethrough in a dropwise manner, said inner tube having a diameter of approximately 1.5 mm;

an outer tube enclosing said inner tube, said outer tube having a diameter of approximately 3 mm;

the inner wall of said outer tube being spaced from the outer wall of said inner tube so as to define a flow path therebetween;

said flow path being adapted to supply a cleaning solution to a tip portion of said inner tube to thereby wash away any concentrated solution or deposit;

said nozzle device being supported by means of a supporting member provided at a circumferential portion of said outer tube; and said tip portion of said inner tube protrudes substantially outwardly from a tip portion of said outer tube.

8. A thin-film apparatus according to claim 7, wherein:

said tip portion of said inner tube protrudes substantially outwardly from a tip portion of said outer tube by approximately 2–6 mm.

9. A thin-film apparatus according to claim 7, wherein:

said nozzle device is substantially exposed to an atmosphere in which said thin-film apparatus is disposed.

10. A thin-film apparatus according to claim 7, wherein:

said flow path is adapted to flow said cleaning solution downwardly around said tip portion of said inner tube at a rate of 0.3–1.5 $cm^3$/sec.

11. A thin-film coating apparatus according to claim 7, further comprising:

a discharge device disposed substantially proximal to said tubes for receiving said cleaning solution.

12. A thin-film coating apparatus according to claim 11, wherein:

a receiver of said discharge device is disposed substantially proximal to said tubes and includes a catching bowl, and is adapted to tentatively receive said cleaning solution and then allow said cleaning solution to overflow.

13. A thin-film coating apparatus, comprising:

a solution dropping nozzle device for applying in a dropwise manner a thin-film coating solution onto a material to be treated;

said thin-film forming coating solution comprising (i) at least one of a diffusion source and an agent for forming metal oxide, as a solute, and (ii) an organic solvent of relatively high volatility, as a solvent;

a spinner adapted to rotate said material;

a casing enclosing said material, said casing being open upwardly; and wherein said solution dropping nozzle device comprises:

an inner tube adapted to cause said coating solution to flow down therethrough in a dropwise manner;

an outer tube enclosing said inner tube;

the inner wall of said outer tube being spaced from the outer wall of said inner tube by a distance of approximately 0.4 mm so as to define a flow path therebetween;

said flow path being adapted to supply a cleaning solution to a tip portion of said inner tube to thereby wash away any concentrated solution or deposit remaining at a peripheral edge portion of said inner tube; and said nozzle device being supported by means of a support member provided at a circumferential portion of said outer tube.

14. A thin-film apparatus according to claim 13, wherein:

said tip portion of said inner tube protrudes substantially outwardly from a tip portion of said outer tube by approximately 2–6 mm.

15. A thin-film apparatus according to claim 13, wherein:

said nozzle device is substantially exposed to an atmosphere in which said thin-film apparatus is disposed.

16. A thin-film apparatus according to claim 13, wherein:

said flow path is adapted to flow said cleaning solution downwardly around said tip portion of said inner tube at a rate of 0.3–1.5 $cm^3$/sec.

17. A thin-film coating apparatus, comprising:

a solution dropping nozzle device for applying in a dropwise manner a thin-film coating solution onto a material to be treated;

a spinner adapted to rotate said material;

a casing for enclosing said material, said casing being open upwardly; and wherein said solution dropping nozzle device comprises:

an inner tube adapted to cause said coating solution to flow down therethrough in a dropwise manner;

an outer tube enclosing said inner tube;

an inner wall of said outer tube being spaced from an outer wall of said inner tube so as to define a flow path therebetween;

said flow path being adapted to supply a cleaning solution to a tip portion of said inner tube to thereby wash away any concentrated solution or deposit remaining at a peripheral edge portion of said inner tube; and said nozzle device being supported by means of a supporting member provided at a circumferential portion of said outer tube.

18. A thin-film apparatus according to claim 17, further comprising:

a discharge device disposed substantially proximal to said tubes for receiving said cleaning solution.

19. A thin-film coating apparatus according to claim 18, wherein:

a receiver of said discharge device is disposed substantially proximal to said tubes and includes a catching bowl, and is adapted to tentatively receive said cleaning solution and then allow said cleaning solution to overflow.

20. A thin-film coating apparatus according to claim 17, wherein:

said tip portion of said inner tube protrudes substantially outwardly from a tip portion of said outer tube by approximately 2–6 mm.

21. A thin-film coating apparatus according to claim 17, wherein:

said nozzle device is substantially exposed to an atmosphere in which said thin-film apparatus is disposed.

22. A thin-film coating apparatus according to claim 17, wherein:

said flow path is adapted to flow said cleaning solution downwardly around said tip portion of said inner tube at a rate of 0.3–1.5 $cm^3$/sec.

23. A thin-film coating apparatus according to claim 17, wherein:

said thin-film coating solution comprises (i) a diffusion source, as a solute, and (ii) an organic solvent of relatively high volatility, as a solvent.

24. A thin-film coating apparatus according to claim 17, wherein:

said thin-film coating solution comprises (i) an agent for forming metal oxide, as a solute, and (ii) an organic solvent of relatively high volatility, as a solvent.

25. Thin film coating apparatus, comprising:

solution dropping nozzle means for applying in a dropwise manner a thin-film coating solution onto a material to be treated;

spinning means for spinning said material;

casing means for enclosing said material, said casing means being open upwardly;

said nozzle means comprising inner tube means for discharging said coating solution from a discharge tip at a lower end thereof in a dropwise manner and outer tube means for supplying a cleaning solution to said discharge tip in a dropwise manner to thereby wash away any concentrated coating solution or deposit remaining at said discharge tip;

said outer tube means being disposed around said inner tube means to define a cleaning solution flow path therebetween; and means for supporting said nozzle means in spaced relation above said casing means.

26. Apparatus according to claim 25, wherein said discharge tip protrudes by approximately 2–6 mm downwardly from said outer tube means.

27. Apparatus according to claim 26, wherein said discharge tip protrudes approximately 2–6 mm below a lower end of said outer tube means.

28. Apparatus according to claim 25, wherein outer tube means supplies said cleaning solution to said discharge tip at a rate of 0.3–1.5 $cm^3$/sec.

29. Apparatus according to claim 25, wherein said supporting means fixes said nozzle means in position above said casing means.

30. Apparatus according to claim 29, wherein said supporting means includes a support member fixed to a vertically-intermediate circumferential portion of said outer tube means.

31. Apparatus according to claim 25, wherein said coating solution comprises (i) a diffusion source, as a solute, and (ii) an organic solvent of relatively high volatility, as a solvent.

32. Apparatus according to claim 25, wherein said coating solution comprises (i) an agent for forming metal oxide, as a solute, and (ii) an organic solvent of relatively high volatility, as a solvent.

33. Apparatus according to claim 25, including discharge means for being operatively interposed between said nozzle means and said casing means to receive said cleaning solution after it has been supplied to said discharge tip.

34. Thin film coating apparatus, comprising:

solution dropping nozzle means for applying in a dropwise manner a thin-coating solution onto a material to be treated;

spinning means for spinning said material;

casing means for enclosing said material, said casing means being open upwardly;

said nozzle means comprising inner tube means for discharging said coating solution from a discharge tip at a lower end thereof in a drop wise manner and outer tube means for supplying a cleaning solution to said discharge tip in a dropwise manner to thereby wash away any concentrated coating solution or deposit remaining at said discharge tip;

said outer tube means being disposed around said inner tube means to define a cleaning solution flowpath therebetween;

means for supporting said nozzle means in spaced relation above said casing means;

discharge means for being operatively interposed between said nozzle means and said casing means to receive said cleaning solution after it has been supplied to said discharge tip; and said discharge means comprising a catching bowl for initially receiving said cleaning solution, and a funnel which supports said catching bowl and receives said cleaning solution after it overflows said catching bowl.

* * * * *

UNITED STATES PATENT AND TRADEMARK OFFICE

CERTIFICATE OF CORRECTION

PATENT NO. : 5,261,566
DATED : November 23, 1993
INVENTOR(S) : Nakayama

It is certified that error appears in the above-indentified patent and that said Letters Patent is hereby corrected as shown below:

Column 6, line 20, change "22.5511" to -- 22.55 --.

Signed and Sealed this

Nineteenth Day of April, 1994

*Attest:*

Bruce Lehman

BRUCE LEHMAN

*Attesting Officer*

*Commissioner of Patents and Trademarks*